US005934758A

United States Patent [19]

Ritch et al.

[11] Patent Number: 5,934,758

[45] Date of Patent: Aug. 10, 1999

[54] MEMBRANE CHAIR

[75] Inventors: David J. Ritch, Malibu; Mark B. Saffell, Manhattan Beach, both of Calif.; Larry A. Wilkerson, Kent City, Mich.

[73] Assignee: Haworth, Inc., Holland, Mich.

[21] Appl. No.: 08/846,616

[22] Filed: Apr. 30, 1997

[51] Int. Cl.[6] ..... A47C 7/02

[52] U.S. Cl. ..... 297/452.54; 297/452.55; 297/300.2; 297/DIG. 2; 24/297; 24/702

[58] Field of Search ..... 297/452.55, 452.22, 297/452.23, 452.24, 452.31, 452.33, 452.36, 451.11, 452.65, 452.58, 452.52, DIG. 2, 452.54, 452.63, 452.64, 300.2, 300.1; 24/297, 702

[56] References Cited

U.S. PATENT DOCUMENTS

| | | | |
|---|---|---|---|
| Re. 25,943 | 12/1965 | Lawson | 297/455 |
| 54,314 | 5/1866 | Farmer . | |
| D. 346,279 | 4/1994 | Stumpf et al. | D6/366 |
| D. 377,431 | 1/1997 | Stumpf et al. | D6/500 |
| 567,639 | 9/1896 | Crouch . | |
| 662,647 | 11/1900 | Howe . | |
| 1,005,330 | 10/1911 | Schmits et al. . | |
| 1,769,294 | 7/1930 | Johnson et al. . | |
| 2,126,439 | 8/1938 | Zerbee . | |
| 2,260,352 | 10/1941 | Trapani . | |
| 2,878,860 | 3/1959 | Brattrud . | |
| 3,041,109 | 6/1962 | Eames et al. . | |
| 3,059,919 | 10/1962 | Marchino . | |
| 3,107,944 | 10/1963 | Baermann . | |
| 3,117,819 | 1/1964 | Kudriavetz, Jr. . | |
| 3,120,407 | 2/1964 | Propst . | |
| 3,140,086 | 7/1964 | Lawson | 267/111 |
| 3,198,578 | 8/1965 | Geoffrey et al. | 297/456 |
| 3,217,786 | 11/1965 | Earl . | |
| 3,233,885 | 2/1966 | Propst . | |
| 3,720,568 | 3/1973 | Rowland . | |
| 3,767,261 | 10/1973 | Rowland . | |
| 3,840,269 | 10/1974 | Ambrose | 297/452 |
| 4,318,556 | 3/1982 | Rowland | 297/445 |
| 4,368,917 | 1/1983 | Urai . | |
| 4,390,210 | 6/1983 | Wisniewski et al. | 297/452 |

(List continued on next page.)

OTHER PUBLICATIONS

IDEA article, Intes USA (1 page).

NEW! Bungie Hi–Back Chair article (1 page).

Aeron Chairs article, Herman Miller, 1995 (4 pages).

Made to Measure article, Chee Pearlman, Sep.–Oct. 1994 (8 pages).

Designers Rate . . . Herman Miller's Aeron Chair article, Interiors, Jul., 1995 (1 page).

*Primary Examiner*—Milton Nelson, Jr.

*Attorney, Agent, or Firm*—Flynn, Thiel, Boutell & Tanis, P.C.

[57] ABSTRACT

An office-type chair, having separate seat and back parts each cushioned and employing a thin inner plastic shell having a perforated central region formed as a thin membrane which is supported solely around the peripheral edge thereof by a suitable ringlike support frame. This membrane is semi-rigid in the plane thereof, but possesses at least limited resiliency in the thickness direction and, being free of direct underlying support, provides direct support for the cushion which in turn engages either the back or posterior of the user to provide limited flexibility and desirable comfort and ergonomic support. The membrane in the central region is provided with a first series of wavy strips which extend between the border of the membrane, with the first strips extending transversely across the membrane in one direction in spaced relationship, and a second series of wavy strips extending transversely across the membrane in the other transverse direction. The individual strips of the two series intersect and are integrally joined to provide the central region of the membrane with a gridlike construction. This gridlike construction which transmits transverse loading substantially uniformly radially outwardly to the surrounding border of the membrane, which border overlies and is fixed to the ringlike frame.

33 Claims, 12 Drawing Sheets

U.S. PATENT DOCUMENTS 4,533,174 8/1985 Fleishman .
4,582,361 4/1986 Kennel .
4,660,887 4/1987 Fleming et al. .
4,761,035 8/1988 Urai .
4,789,201 12/1988 Selbert .
4,828,320 5/1989 Saiger .
4,834,458 5/1989 Izumida et al. .
5,013,089 5/1991 Abu-Isa et al. .
5,067,772 11/1991 Koa ..... 297/452
5,094,580 3/1992 Abe .
5,154,485 10/1992 Fleishman .
5,439,271 8/1995 Ryan .
5,441,331 8/1995 Vento .
5,445,436 8/1995 Kemnitz .
5,529,373 6/1996 Olson et al. .

MEMBRANE CHAIR

FIELD OF THE INVENTION

This invention relates to office-type chairs and, more particularly, to office chairs having seat and back assemblies which include inner plastic membranes or shells for supporting cushions thereon.

BACKGROUND OF THE INVENTION

Office chairs have been developed where seat and back assemblies thereof are tiltable forwardly and rearwardly. One type of office chair is commonly referred to as a "synchro-tilt" type chair wherein the back assembly tilts synchronously with respect to the seat assembly but at a greater rate. While numerous improvements to these chairs have been made to improve the comfort of a user, for example, with respect to the design of the seat and back assemblies, such office chairs typically includes planar sheetlike inner shells which support the seat and back of a user. These inner shells typically are directly supported on a bottom surface thereof by rigid structures such as a housing for a tilt control mechanism or a vertical upright which supports the back assembly. Since these inner shells are typically formed of plywood or of thick or reinforced plastic sheets and are directly supported generally in the central regions thereof where the seat and back of a user typically are positioned, seat and back cushions are provided in an effort to provide comfortable and ergonomic support of a user. While the cushions conform to the contours of the user, these cushions are still typically supported by relatively rigid shells. Thus, when the cushions are highly compacted by the weight of a user, the seat and back assembles often provide a greater degree of rigidity than is desired.

To assist in accommodating the contours of a user, the relatively rigid inner shells typically are curved and contoured in an effort to increase the comfort of the user. Since each user has their own individual characteristics, such contours as provided to the inner shells are determined according to the characteristics of an "average" user. However, since each occupant has unique characteristics with respect to body size, contour and shape, an occupant still may not necessarily conform to the contour of the inner shell. Further, the contours of the inner shell tends to accommodate a user when stationary, and thus the contoured shapes do not necessarily accommodate user movements such as twisting or shifting.

In an effort to provide greater comfort, chairs have been provided which attempt to accommodate the individual characteristics of the user, as well as movements thereof, by providing flexible support surfaces for the seat and back. For example, one office chair provides a suspended sheet of material which is similar to a woven plastic material that is supported on its edges and thereby attempts to conform to the characteristics and movements of a user. This material is exposed during use so as to depart from the conventional appearance of an office-type chair which typically uses cushions.

In other office-type chairs, the seat and/or back are defined by sheetlike elastic materials which are formed into elongate spring elements which anchor at opposite ends on opposite side frame elements, and the intermediate spring is defined by a closely positioned sinusoidal configuration, with the spring typically having significant width for direct contact with the posterior or back of the occupant. With such arrangement, one or more such springs typically extend transversely of the seat or back, and are anchored solely at the ends, and provide for control of forces solely in a single transverse direction. Such arrangements thus often provide too much and uncontrolled flexibility, and in particular do not provide for desired uniform control of flexibility in both transverse directions of the seat or back.

In still another chair intended for use in an office, the seat and back areas are open and bungee cords are extended sidewardly from frame members on opposite sides of the chair. Here again, the seat and back are open and the suspension system is exposed during use.

Other examples are chairs of the type having a fixed nontiltable rigid frame formed of tubular members. These chairs use an exposed open webbing formed of plastic-coated spring wires which are connected along the opposite side edges thereof to the fixed frame and support the seat and back of a user in the open areas between the frame members. These chairs, however, individually connect the spring wires to the side frame elements, and do not provide uniformity in the transverse supporting directions of the seat and back.

Examples of chairs of the type described above are illustrated by U.S. Pat. Nos. 2,649,146, 3,720,568, 3,767,261, 4,202,581, 4,390,204, 4,502,731, 4,533,174 and 4,660,887.

In view of the foregoing, it is an object of the invention to provide an improved office-type chair provided with cushions for the seat and back which are supported by a dynamic suspension system to accommodate the contours and movements of a user. It is a further object that this suspension system include plastic inner membranes which support the cushions over an entire interior surface thereof while being at least of limited resilient flexibility at least in the center region thereof. It is a still further object to provide a chair frame which supports the inner shells on the peripheral edge thereof so as to support the seat of a user bi-directionally, i.e. both sidewardly between the opposite sides of the chair and rearwardly between the front and back of the chair. Similarly, it is an object to also support the back of a user bi-directionally, i.e. both sidewardly and vertically between the top and bottom of the chair back. It is a further object that the inner membranes be of a one-piece construction to which the cushions may be fixedly attached to define a cushion assembly.

More specifically, the present invention relates to an improved chair, particularly an office-type chair, having separate seat and back parts each being cushioned and employing a thin inner plastic shell having a central region formed generally as a thin membrane which is supported solely around the peripheral edge thereof by a suitable ringlike support frame. This membrane is relatively strong and generally semi-rigid in the plane thereof, but possesses at least limited resiliency or flexibility in the direction of the thickness thereof and, being free of direct underlying support, provides direct support for the cushion which in turn is engaged by either the back or posterior of the chair occupant to thus provide for limited flexibility while at the same time providing for desirable comfort and ergonomic support. The membrane in the central region is preferably provided with a first series of strips which extend between the border of the membrane, with the first strips extending transversely across the membrane in one direction in spaced relationship, and a second series of such strips extending transversely across the membrane in the other transverse direction. The individual strips of the two series intersect and are integrally joined so as to provide the central region of the membrane with a gridlike construction as defined by the strips. This gridlike construction, and the fact that the occupant loading is imposed transversely thereon due to the pressure of the back or posterior, transmits this transverse loading substantially uniformly radially outwardly to the surrounding border of the membrane, and thence to the appropriate supporting frame, to provide the desired resilient support of the occupant.

Other objects and purposes of the present invention, including the desired structural and functional aspects thereof, will be apparent to persons familiar with structures of this general type upon reading the following specification and inspecting the accompanying drawings.

Figure 1:
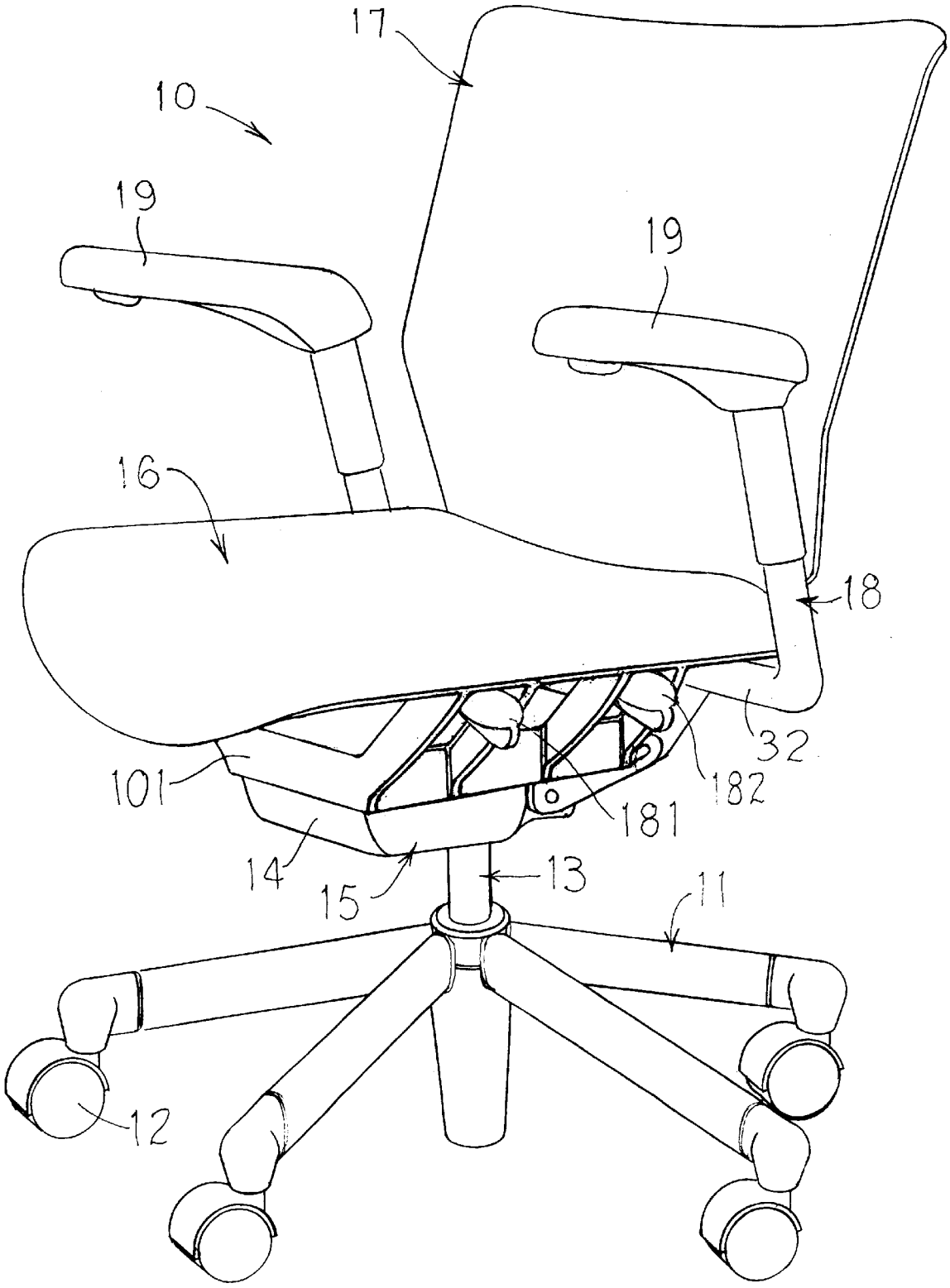
FIG. 1 is a perspective view of a chair embodying the improved constructional features of the present invention.

Certain terminology will be used in the following description for convenience in reference only, and will not be limiting. For example, the words "upwardly", "downwardly", "rightwardly" and "leftwardly" will refer to directions in the drawings to which reference is made. The word "front" will refer to that side of the chair which is usually accessed by the occupant, and the word "rear" will refer to the opposite side of the chair. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Figure 2:
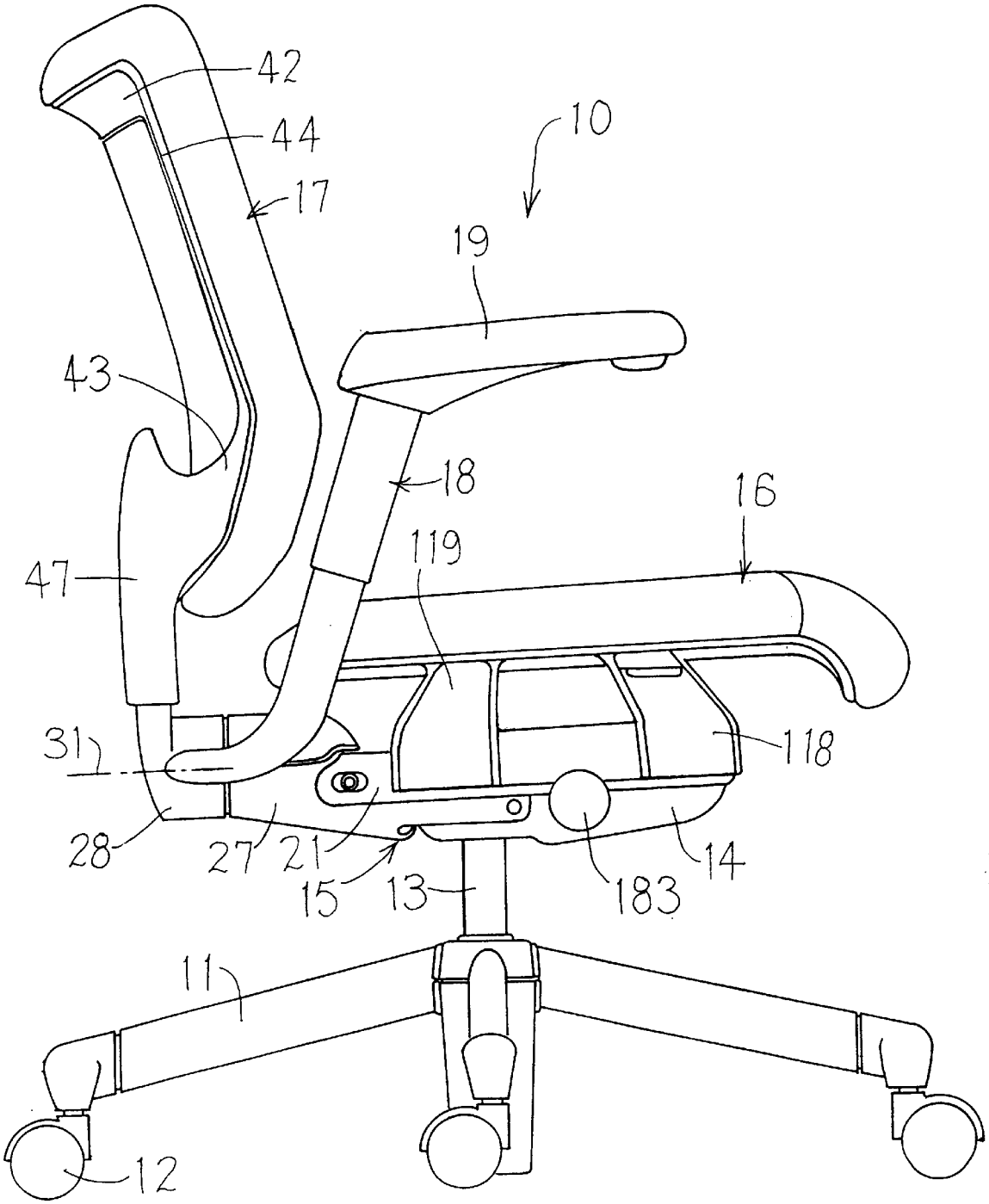
FIG. 2 is a side elevational view of the chair shown in FIG. 1.
Figure 3:
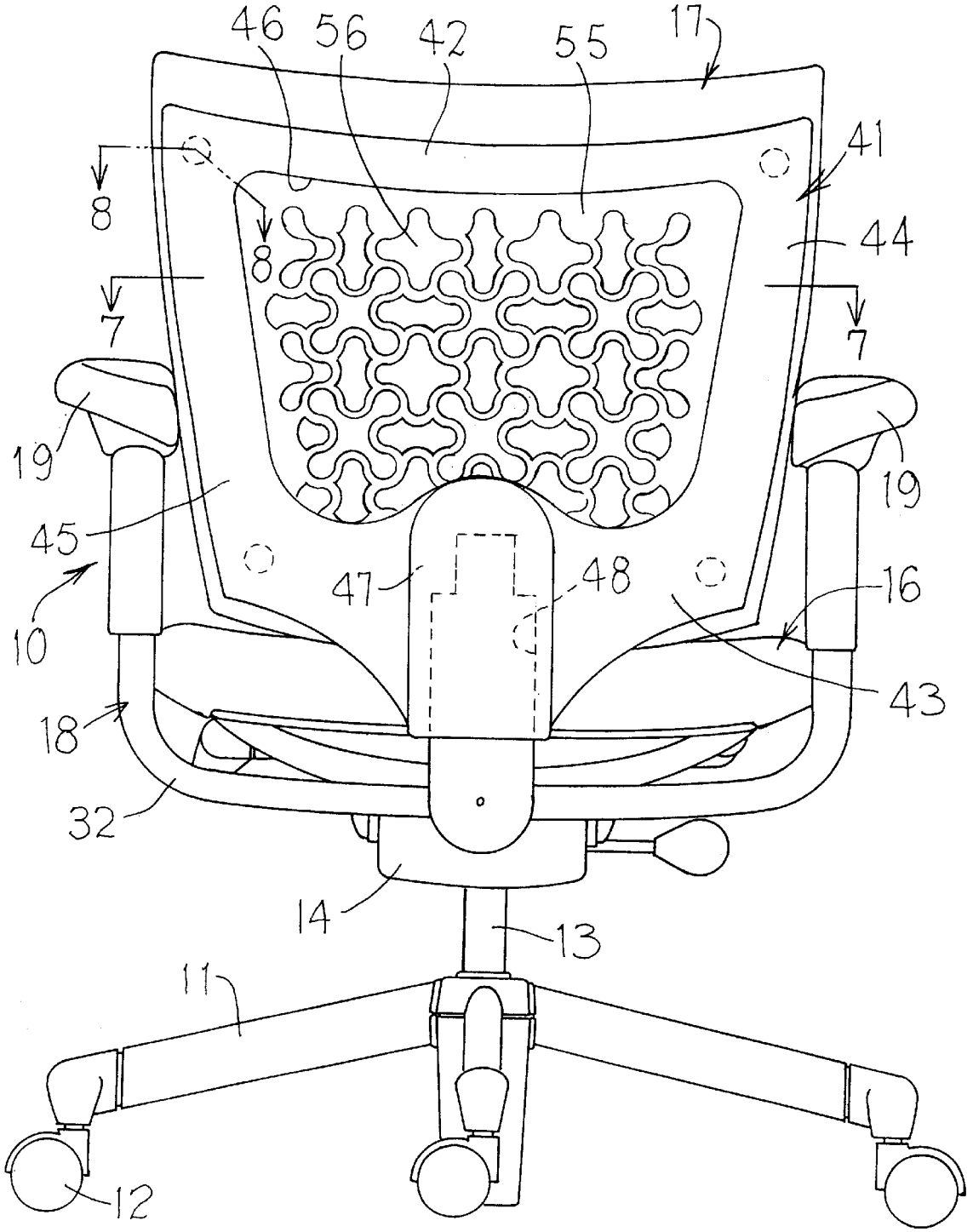
FIG. 3 is a rear elevational view of the chair shown in FIG. 1.

Referring to the drawings and specifically FIGS. 1–3, there is illustrated an office-type chair 10 according to the present invention. This chair includes a multiple-leg base 11 which, as is conventional, is provided with casters or rollers 11 adjacent the ends of the legs for rolling support on a floor. The base defines therein an upwardly projecting center pedestal 13 which, as is conventional, includes a chair height-adjusting mechanism, such as a conventional pneumatic height-adjusting cylinder. The upper end of this pedestal 13 joins to a boxlike housing 14 which mounts therein a spring-biased tilt control mechanism 15, the latter being conventional and well known in the chair art, and being provided to permit vertical rearward tilting of the seat back, and also to possibly permit limited vertical tilting of the chair seat, such as permitted by a conventional synchro-tilt type control mechanism.

In the illustrated arrangement, the chair 10 includes a seat assembly 16 and a back assembly 17 which are supported on and the movement controlled by the tilt control mechanism 15. An arm arrangement 18 is, in the illustrated embodiment, associated with the chair, which arm arrangement includes a pair of arms, namely right and left arms 19, which are disposed adjacent opposite sides of the chair in upwardly spaced relation from opposite sides of the seat assembly 16.

Figure 4:
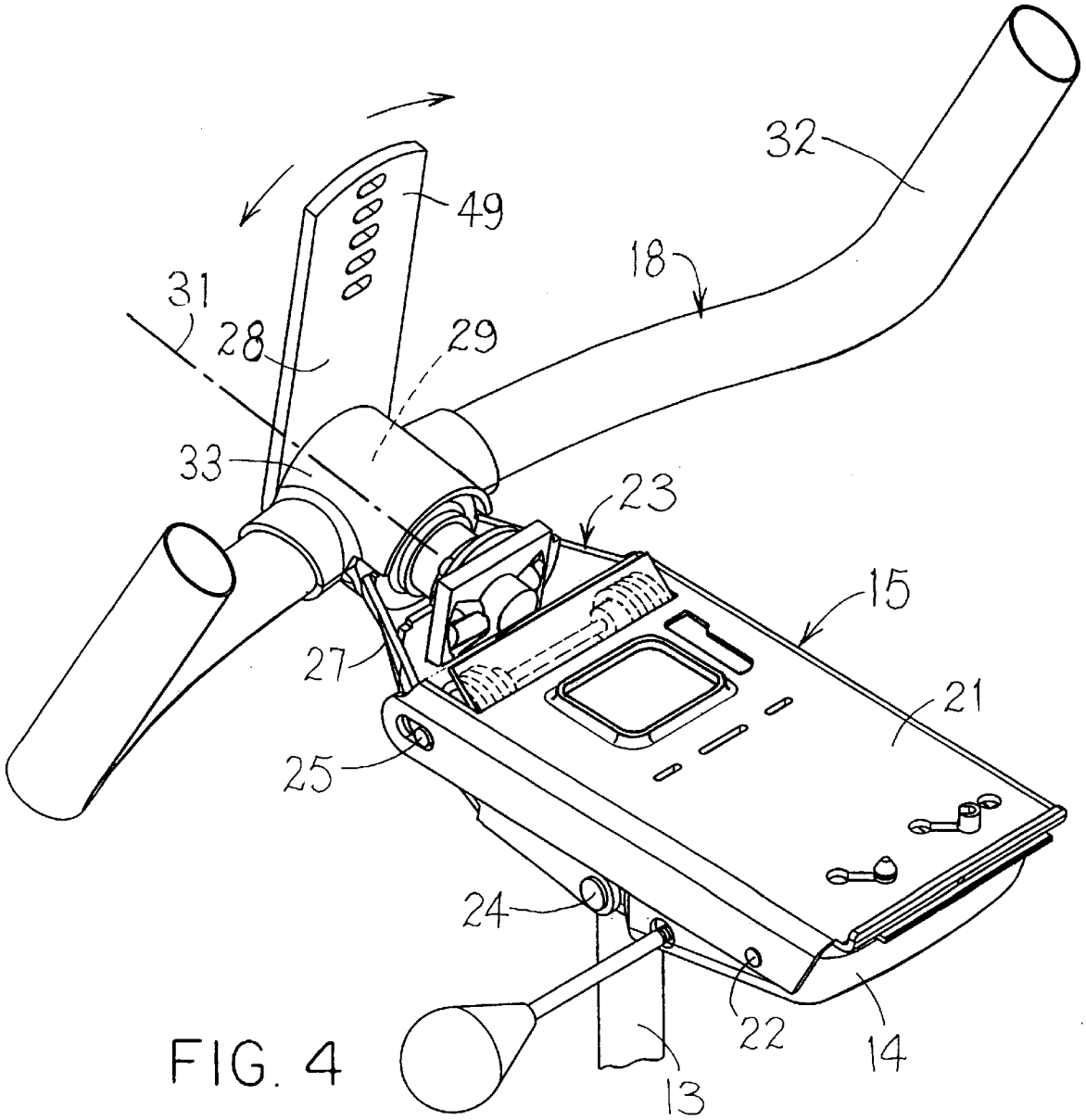
FIG. 4 is a fragmentary perspective view of the control mechanism and its attachment to the arm assembly, the other chair components being eliminated for clarity of illustration.
Figure 5:
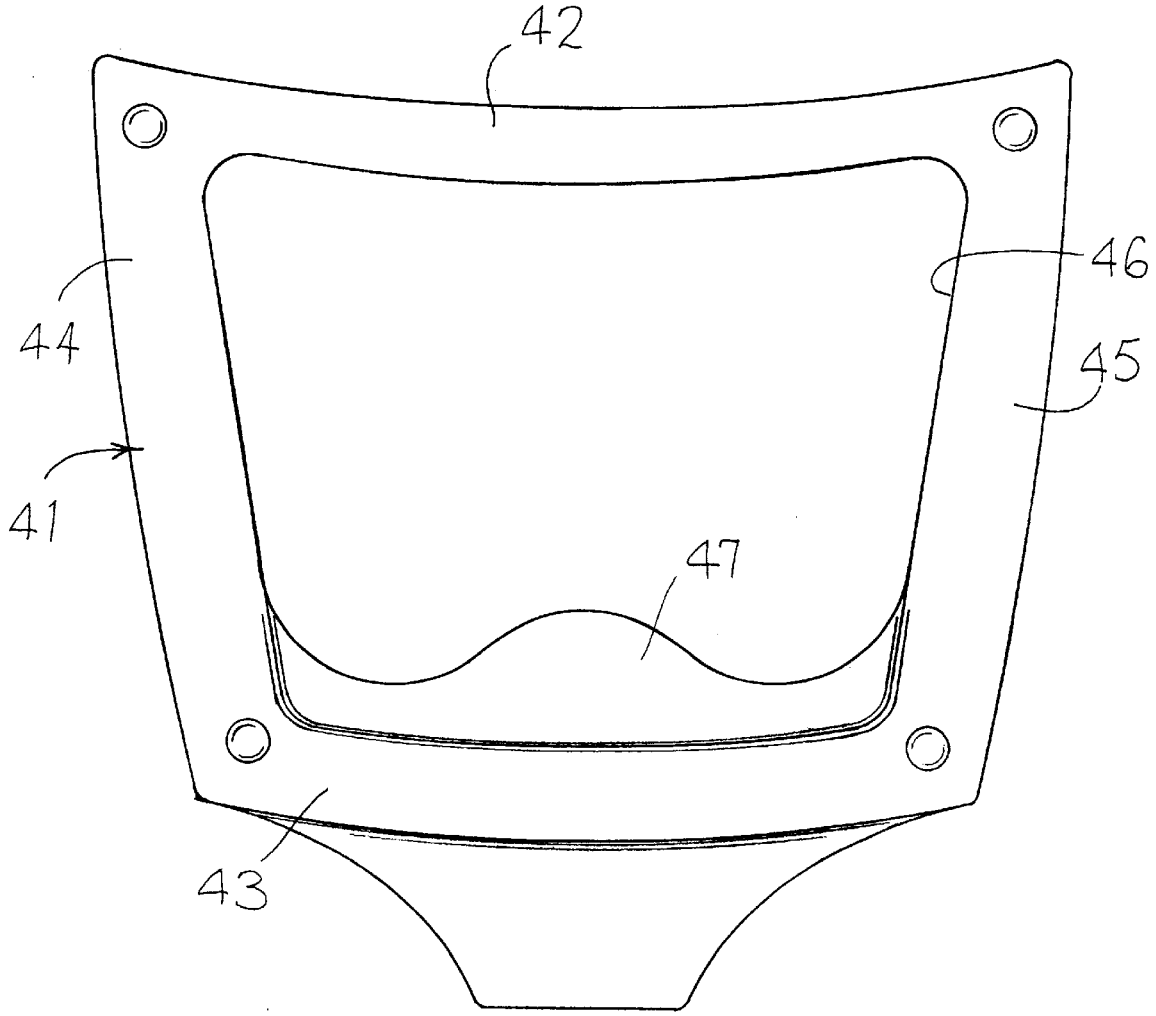
FIG. 5 is a front view of the back support frame for the chair of FIG. 1.
Figure 6:
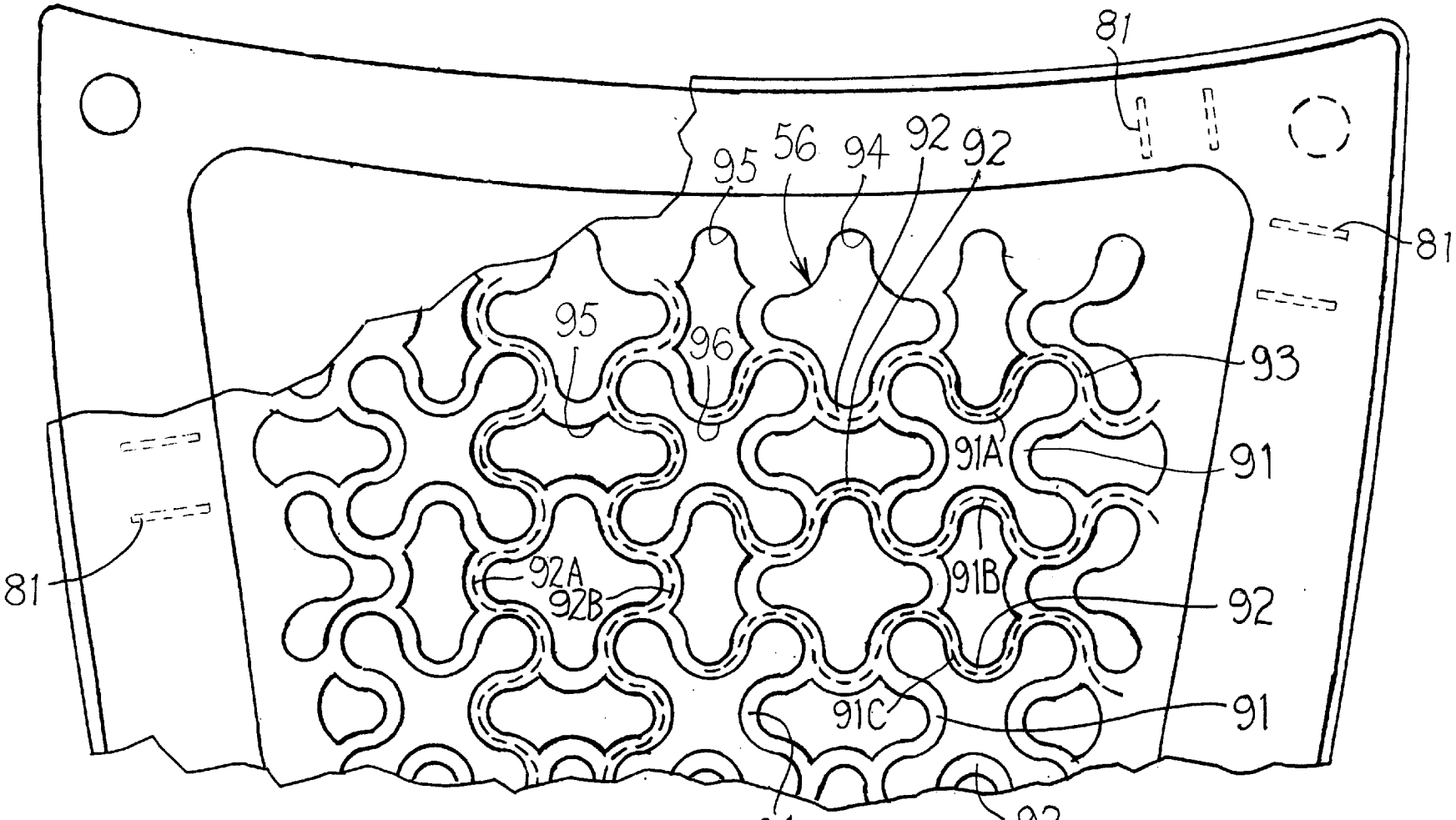
FIG. 6 is a front view of the inner shell member which is positioned over the back support frame of FIG. 5.

The tilt control mechanism 15 (FIG. 4) includes a top support plate or member 21 which mounts thereon the seat assembly 16. This top support plate 21 in the illustrated embodiment is movably and swingably supported on the housing 14 by a generally transversely extending horizontally hinge 22 which is disposed under the seat in the vicinity of the front edge thereof to permit limited but controlled downward tilting of the rear portion of the seat. The tilt control mechanism 15 also includes a back tilt control member 23, often referred to as an upright, the latter at its forward end being joined by a transverse horizontal hinge 24 to the housing 14, with this back tilt control member 23 also being joined by a transverse horizontal hinge 25 to the top support plate 21, this latter hinge 25 defining sufficient clearance, as by means of an elongate slot, to permit relative tilting movement between the support plate 21 and the back tilt control member 23.

The back tilt control member 23 projects rearwardly and upwardly for support of and controlling movement of the back assembly 17. This back tilt control member 23, in the illustrated embodiment, includes a front part 27 which is hingedly supported on the control housing 14, and a rear part 28 which projects rearwardly and upwardly for structural connection to the back assembly 17. These front and rear parts 27 and 28, in the illustrated embodiment, are joined together through a hinge/bearing arrangement 29 which defines a generally horizontal hinge axis 31 which projects in the front-to-rear direction of the chair to permit at least limited sideward tilting of the back assembly 17 relative to the seat assembly 16 about the axis 31.

In addition, the arm arrangement 18 in the illustrated embodiment includes a generally U-shaped yoke 32 which joins the arms together and which projects downwardly and rearwardly, with this yoke 32 being provided with a central annular hub 33 which is generally fixed to the rear upright part 28 in concentric relationship to the axis 31. This thus fixedly joins the arm arrangement 18 to the back assembly 17 so that the arm arrangement 18 and back assembly 17 can be sidewardly angularly tilted as a unit about the axis 31. In addition, the arm arrangement 18 is also rearwardly tilted in conjunction with the rear tilting of the back tilt control member 23 so that the arm arrangement 18 and seat back 19 thus simultaneously tilt rearwardly as a unit.

A preferred construction of the chair control 15 is disclosed in copending application Ser. No. 08/846,618, entitled TILT CONTROL FOR CHAIR, filed concurrently herewith (Atty Ref: Haworth Case 217). The disclosure of this copending application is, in its entirety, incorporated herein by reference.

The construction of the back tilt control member 23 and specifically the construction thereof for permitting sideward hinging or torsional displacement of the back assembly relative to the seat assembly is disclosed in copending application Ser. No. 08/846,614, entitled CHAIR BACK WITH SIDE TORSIONAL MOVEMENT, filed concurrently herewith (Atty Ref: Haworth Case 216). The disclosure of this latter application, in its entirety, is also incorporated herein by reference.

The construction of the back assembly 17 will now be described with reference to FIGS. 3 and 5–9.

The back assembly 17 includes a generally ringlike support frame 41 (FIG. 5) having generally parallel and generally horizontally elongated upper and lower support rails 42 and 43 respectively, the latter being integrally and rigidly joined adjacent opposite ends to generally parallel and generally vertically extending right and left side rails 44 and 45 respectively. The thus formed support frame 41 defines a generally enlarged central opening 46 extending therethrough. The support frame 41 also has a generally vertically elongated support part 47 which is integrally fixed to the lower rail 43 substantially at the center thereof. This support part 47 projects rearwardly from the lower support rail, as shown in FIG. 2, and is elongated upwardly and downwardly in generally cantilevered relation relative to the lower support rail. This support part 47 defines therein an interior downwardly opening recess 48 which slidably accommodates therein an upwardly projecting support plate 49 which is fixedly associated with and defines a portion of the rear upright part 28. This support plate 49 is vertically slidably engaged within the support part 47, and a suitable height adjusting latch structure (not shown) cooperates therebetween, the latter comprising a spring-urged and manually accessible latch member which is movably mounted on the support part 47 and cooperates with slots or openings in the support plate 49 for permitting the height of the back assembly 17 to be vertically adjusted relative to the remainder of the chair. The back height adjusting mechanism may comprise any generally conventional configuration, such mechanism being well known and hence further detailed description thereof is believed unnecessary. One example of a suitable mechanism is shown in U.S. Pat. No. 4,639,039.

Figure 7:
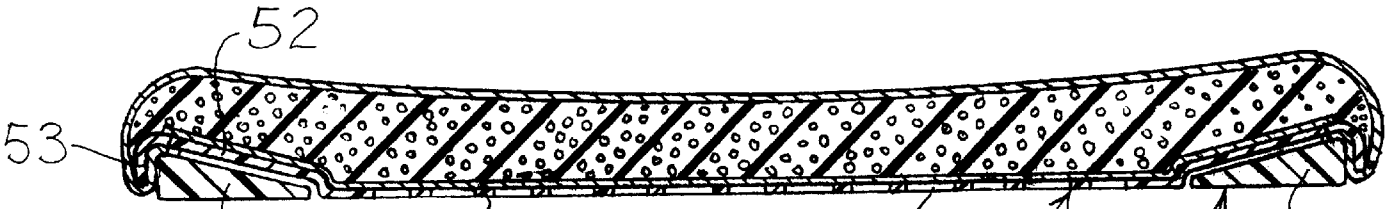
FIG. 7 is an enlarged and generally horizontal crops sectional view of the chair back as taken generally along line 7—7 in FIG. 3.

The rails 42–45 of the back support frame 41 preferably have a configuration which, when viewed in cross section as illustrated in FIG. 7, is of a generally triangular or wedgelike shape which is of reduced thickness as the cross section projects toward the center opening 46. The front surfaces of the rails are preferably sloped slightly rearwardly as they project inwardly to provide improved comfort when the back assembly is contacted by the back of the user. The seat support frame 41 is preferably constructed as an integral one-piece member, such as by being molded of a structural or engineered resin material, such as a glass-filled nylon, having the requisite strength and rigidity.

Figure 8:
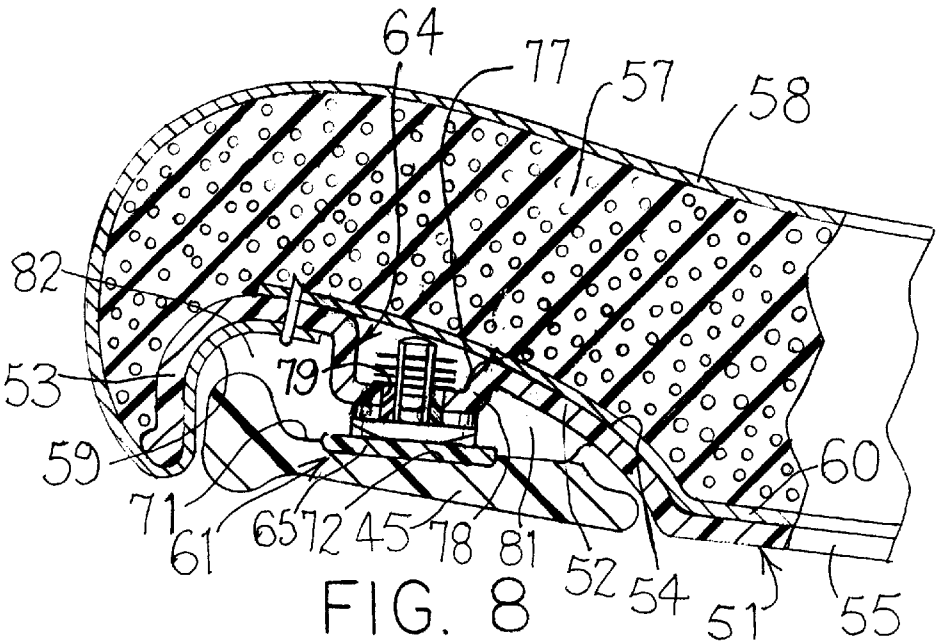
FIG. 8 is an enlarged fragmentary sectional view take generally along line 8—8 in FIG. 3 and showing the securement of the back membrane to the back frame.
Figure 10:
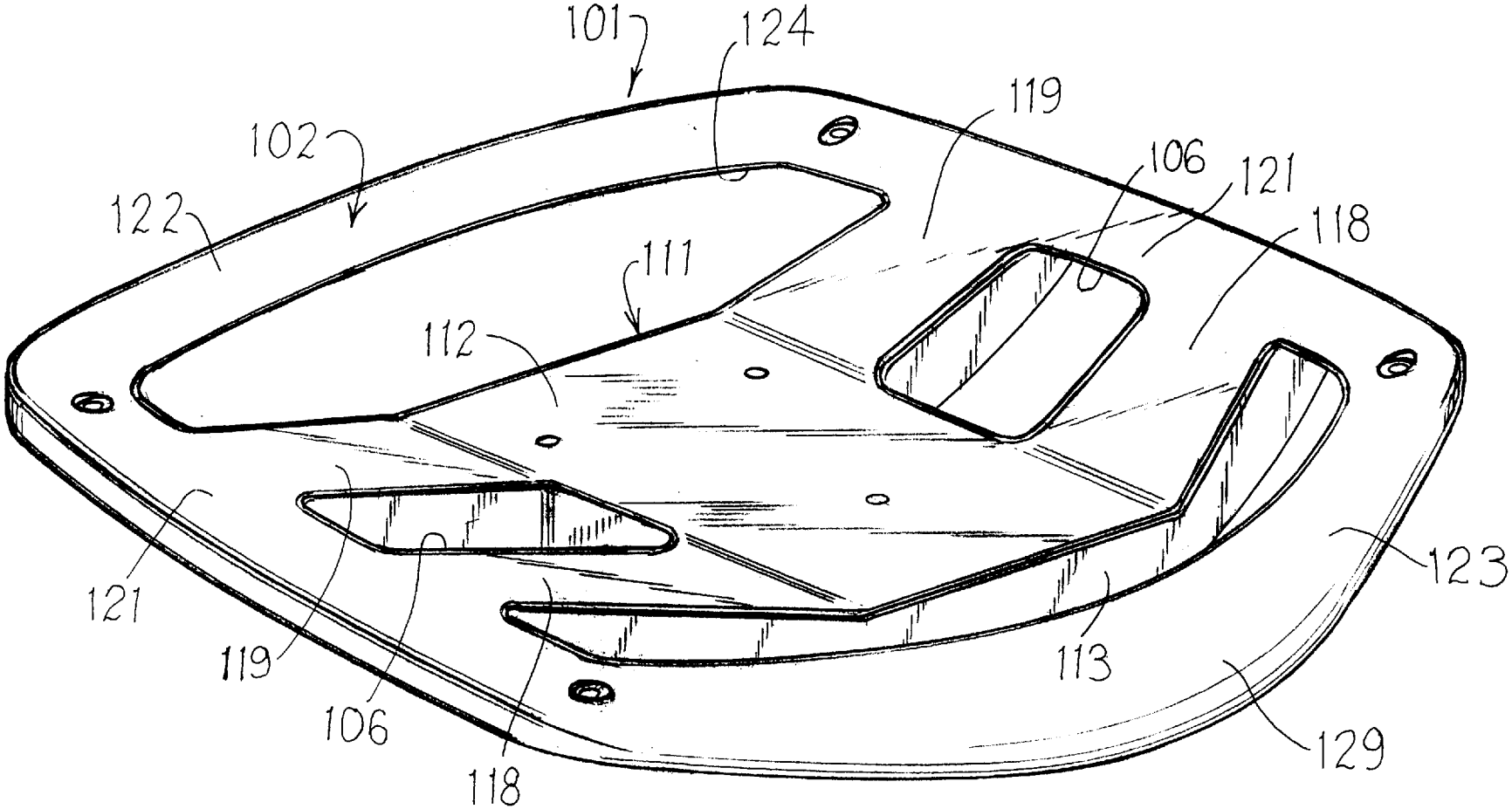
FIG. 10 is a perspective view of the seat member.
Figure 11:
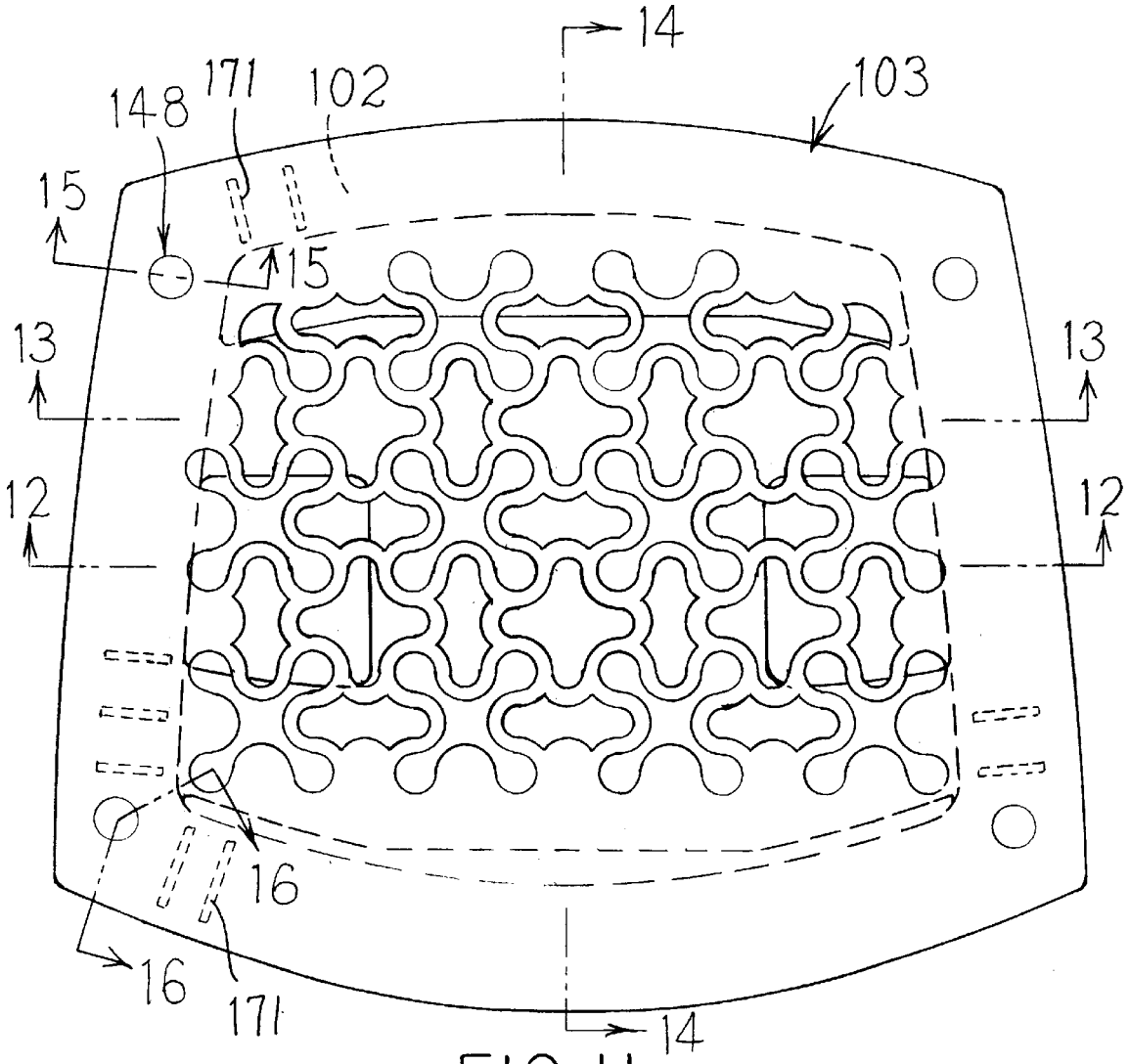
FIG. 11 is a top view of the inner shell or membrane as mounted on the seat member of FIG. 10.
Figure 12:
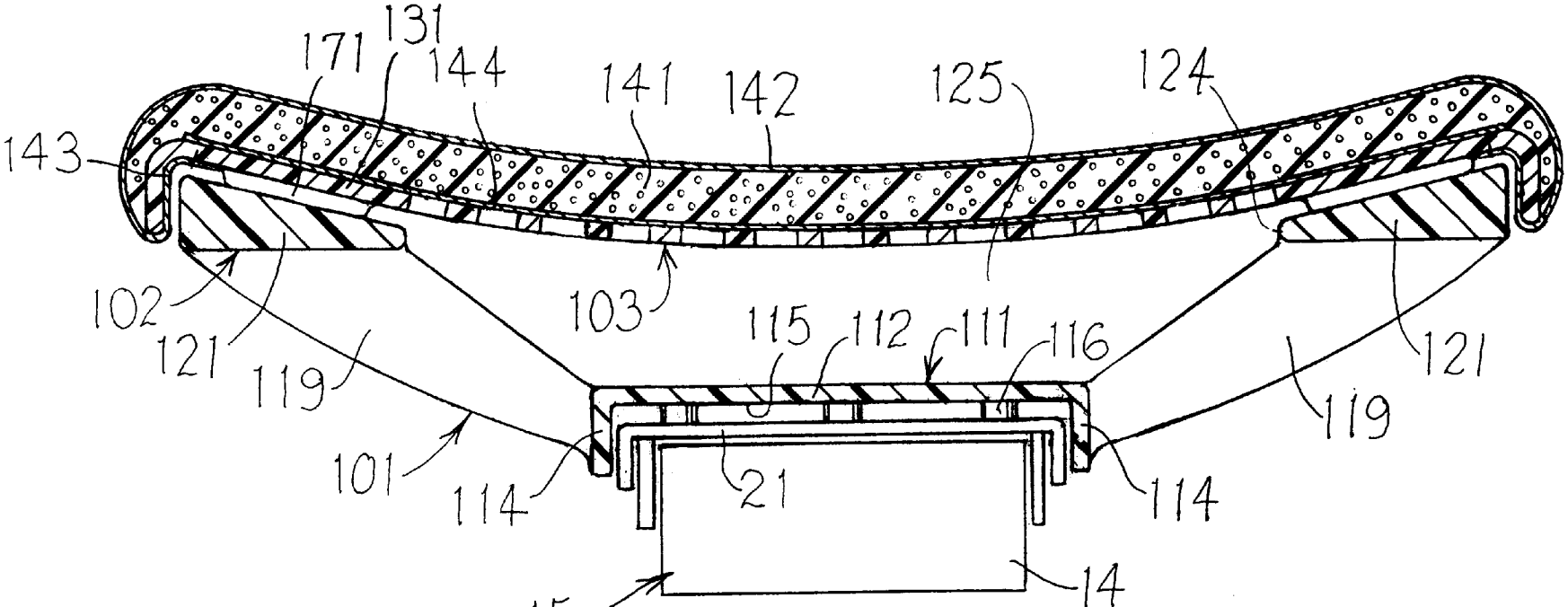
FIG. 12 is a generally vertical sectional view of the chair seat as taken generally along line 12—12 in FIG. 11 and also including the cushion and fabric.

The back assembly 17 also includes an inner shell or membrane member 51 which is designed to be fixedly secured to and positioned adjacent the front side of the back support frame 41. This inner shell or membrane 51 includes an outer generally rectangular ringlike retainer or rim part 52 which terminates in a transversely and rearwardly projecting outer edge flange 53 around substantially the entirety thereof. The rim part 52 and its cooperation with the outer edge flange 53 defines, in cross section, a shallow rearwardly-opening channel which generally accommodates therein the respective rail of the back support frame 41, as illustrated by FIGS. 7 and 8, whereby the edge flange 53 effectively overlaps the outer peripheral edge of the back frame. The rim part 52 defines thereon a front surface 54 which, from its junction with the outer edge flange, is generally smoothly convexly curved and slopes rearwardly as it projects inwardly toward the center open region of the frame. The inner edge of the rim part 52 is then integrally joined to an enlarged center part 55 of the shell, the latter in effect defining an enlarged and substantially flat sheetlike membrane which extends across and effectively closes off the central opening 46 of the back frame 41. This center membrane part 55 has a plurality of openings 56 extending transversely through the thickness thereof so that the center membrane part 55 defines a mesh or gridlike structure which will typically be visible from the rear side of the chair for decorative purposes. This center membrane part 55, however, is also free of rearward support so as to provide at least limited flexibility and desirable ergonomic support in response to forces imposed transversely thereagainst by the back of the chair occupant. The construction of the center membrane part 55 is explained in greater detail hereinafter.

The chair back assembly 17 also includes a cushion assembly which is disposed on the front side of the inner shell, which cushion assembly includes a rather thick foamed cushion 57 which has the rear surface thereof positioned on and extending generally coextensively over the front surface of the inner shell 51. This foamed cushion 57 in turn is covered by a thin and flexible upholstery layer 58, typically a fabric. The fabric layer 58 has the outer edge 59 thereof wrapped around the edge flange 53 of the inner shell 51 so that the fabric edge 59 wraps onto the back side of the shell and is suitably secured thereto, as by fasteners such as staples or the like.

The back assembly 16 also preferably includes a thin flexible covering, such as a fabric 60 positioned so as to overlie the rear surface of the back shell 51, which fabric 60 is preferably interposed between the cushion 58 and the back shell 51 as illustrated by FIG. 8 and extends across at least the center membrane part 55. This thus results in the fabric 60 extending across the series of openings 56 formed in the center membrane part 55, thereby permitting an aesthetic change in the appearance of the chair by providing for design characteristics, such as by permitting a matching or contrasting fabric 60 to be visible through the openings of the center membrane part. This fabric also structurally assists in confining the foam and preventing extrusion thereof into or through the openings in the center membrane part.

To secure the inner shell 51 to the back support frame 41, a plurality of substantially identical securing structures 61 are provided at spaced intervals around the frame 41 for fixed securement to the shell 51. In the illustrated embodiment four such securing structures 61 are provided, same being indicated by dotted circles in FIG. 3, with these securing structures 61 being positioned generally in the vicinity of the four corners of the frame 41.

Figure 9:
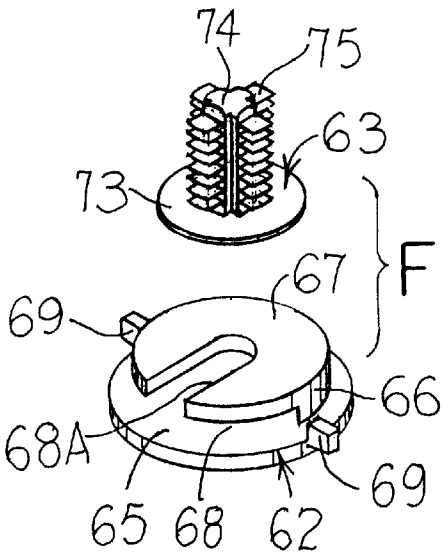
FIG. 9 is an enlarged perspective view illustrating the retainer used for securing the back membrane to the back frame in FIG. 8.

The securing structure 61, as illustrated in FIGS. 8 and 9, includes a first plastic retainer member 62 which is fixedly secured to the back frame 61, and this first retainer member 62 in turn removably mounts thereon a second plastic retainer member 63 which creates a securing engagement with a retainer portion 64 which is formed integrally in the rim portion 52 of the inner shell 51.

More specifically, the first retainer member 62 includes a base plate 65 having a flange 66 projecting upwardly therefrom, the latter flange being approximately a half circle, and this projecting flange 66 in turn joins to a top plate 67 which is generally parallel with and overlies the base plate 65 and is spaced therefrom so as to define an open region or compartment 68 therebetween, the latter being opened on one side inasmuch as the connecting flange 66 extends only partway around this compartment. The top plate 67 also has a slot 68A which opens radially inwardly from the edge thereof, which edge defines the open side of the compartment, with this slot 68A opening downwardly through the top plate 67 into the compartment 68. The bottom or base plate 65 also has a pair of drive lugs 69 which project radially outwardly from diametrally opposite sides thereof.

To accommodate the securing structure and specifically the first retainer member 62, the support frame 41 is provided with a shallow recess 71 formed inwardly from the front surface thereof so as to define a substantially flat bottom surface 72. The base plate 65 of the first retainer member 62 is positioned in this recess 71 for engagement with the flat bottom surface 72. The retainer member 62 is fixedly secured to the frame member 41 by means of a conventional spin welding technique. That is, the base plate 65 is pressed into engagement with the surface 72 and is rotatably driven at relatively high speed by a suitable tool which engages the driving lugs 69. The frictional heat generated effects melting between the plastic base plate 65 and the plastic frame member 41 sufficient to effect a fixed securement therebetween. When this fixed securement occurs, the driving tool effectively shears the drive lug 69 from the base plate. Such spin welding is conventional.

Considering now the second retainer member 63, it is what is commonly referred to as a Christmas tree fastener, and it includes an enlarged head 73 which is fixedly and integrally joined to one end of an elongate stem 74. This stem 74 in turn has a plurality of resilient flanges 75 projecting sidewardly therefrom. The plurality of flanges 75 are disposed in closely adjacent but axially spaced relation along the stem, and are also typically formed so as to be sloped inwardly relative to the head as they project radially outwardly. This second retainer member 63 is engaged within the first retainer member 62 by inserting the enlarged head 73 sidewardly into the compartment 68 so that the stem 74 projects outwardly through the slot 68A, thereby captivating the head of the Christmas tree 62 between the plates 65 and 67.

The second retainer member 63 then creates a fixed engagement with the retainer portion 64 formed on the shell 51 to effect securement of the shell 51 to the back frame 41. This retainer portion 64 is defined by means of a cuplike recess 77 which is deformed inwardly from the front or outer surface of the rim part 52 during forming or molding of the shell. This cuplike recess 77, in the relatively flat bottom wall 78 thereof, has an opening 79 formed therethrough. This opening 79 has a diameter which is greater than the diameter of the Christmas tree stem 74, but less than the diameter of the resilient flanges 75. The Christmas tree stem and flanges are insertable through this opening 79, causing inward deflection of the flanges 75 until the inner shell 51 is properly seated on the seat frame 41. The inner shell is locked in the desired seated position due to the resilient flanges 75, after they pass through the opening 79, deflecting radially outwardly to create a lock. Christmas tree type fasteners are conventional, and further description of the general function thereof is believed unnecessary.

To facilitate proper seating of the inner shell 51 on the back frame 41, the inner shell 51 may be provided with a plurality of support ribs 81 projecting outwardly from the rear surface thereof. Such support ribs 81 will preferably be disposed in closely adjacent but spaced relationship along the rear face of the rim 52, particularly in the regions extending between adjacent securing structures 61, with the ribs being elongated inwardly and terminating adjacent the perforated center membrane part 55, whereby these ribs 81 engage the front surface of the frame 41 to provide a solid support for the inner shell. This support between the ribs 81 and the frame 41 will be provided adjacent the inner edge of the rim, namely the portion of the rim which is disposed directly adjacent the center membrane part 55.

The outer portion of the shell rim 52, namely that portion adjacent the edge flange 53, will normally be shaped so as to be positioned forwardly from the seat frame 41 to define a clearance space or region 82 therebetween. This latter region or space 82 is provided so as to accommodate therein the edge 59 of the upholstery fabric so that this edge is thus captivated in this space 82 between the frame and shell, and is thus hidden from view. This space 82 also is sufficiently enlarged so as to accommodate the inherent puckering which typically occurs along the fabric edge 59.

Considering now the construction of the inner back shell 51, same is preferably formed as a one-piece sheetlike member, such as by being molded from a synthetic engineered resin material, preferably a plastic material having at least limited elasticity or resiliency. The shell 51 will preferably be of relatively thin but substantially uniform thickness throughout, which thickness will typically be in the range of from about ⅛ to about ¼ inch.

As to the center membrane part 55 of the shell 51, it is substantially flat and hence substantially planar when in a nondeformed condition, and is preferably defined by a plurality of first strips 91 (FIG. 6) which are disposed in vertically spaced relation from one another and extend generally horizontally across the shell for integral connection with opposite sides of the rim part 52, and in addition is defined by a plurality of second strips 92 which are sidewardly spaced apart and extend generally vertically across the shell for connection to the upper and lower portions of the rim part and for intersecting connection with the first strips 91. These first and second strips 91 and 92 are both preferably of a generally wavy or sinusoidal configuration as defined in the plane of the membrane. The plurality of first strips 91 are all sidewardly spaced so as to not directly contact or join one another, and the second strips 92 are similarly also sidewardly spaced so as to not directly join or contact one another. However, the first and second strips themselves extend generally in transverse relationship to one another relative to the seat shell, and thus each first strip 91 intersects each second strip 92 at an intersection region 93 which is common to the two intersecting strips.

Each adjacent pair of first or horizontal strips 91, as indicated by the dotted-line centerlines 91A and 91B of an adjacent pair of strips 91, and as also indicated by the next adjacent pair of strips 91B and 91C, are reversely oriented. That is, the adjacent strips 91 are positioned so as to be substantially mirror images of one another with respect to the open space defined between the adjacent pair of strips. The second or vertical strips 92 are similarly oriented such that each adjacent pair of such strips are disposed in a substantially mirror image relationship, such as indicated by the adjacent pair of centerlines 92A and 92B.

Due to the center membrane part 55 of the back shell 51 being defined by the plurality of transversely intersecting strips 91 and 92, the center membrane part is thus defined with the plurality of openings 56 therebetween, which openings assume several different shapes and specifically include a plurality of four-pointed star-shaped openings 94, a plurality of elongated slot-like openings 95, and a plurality of X-shaped openings 96. The specific configuration of the strips and their positional relationships thus result in adjacent rows of openings which extend both vertically and horizontally of the center membrane part 55, with one vertical row of openings including the star-shaped openings 94 disposed in alternating spaced relationship with respect to transversely elongated slotlike openings 95, whereas the next adjacent vertical row of openings includes a plurality of X-shaped openings 96 positioned alternately with respect to longitudinally elongated slotlike openings 95. The adjacent horizontally extending rows of openings are similarly configured.

The back shell 51 may, in a preferred construction, be formed of polypropylene or an equivalent material so that the shell will be semi-rigid but will possess limited transverse flexibility or resiliency, particularly in the enlarged center membrane part 55. The construction of the center membrane part 55, and the fact that occupant-imposed loads thereon will be imposed generally transverse to the sheetlike center membrane part 55, will thus cause limited transverse flexibility or deformation of the center membrane part in the rearward direction of the chair so as to enable the chair to conform to the back of the user and thus provide for a comfortable but desirable ergonomic support of the occupant's back. The provision of the integrally joined and transversely interconnected strips 91 and 92, and the fact that a plurality of such strips 91 and 92 extend both vertically and horizontally across the back shell and are joined to the ringlike rim part 92 at substantially closely adjacent and generally uniformly spaced intervals therearound, thus ensures that any transverse loads imposed on the center membrane part 55 are thus radiated or transmitted outwardly along the strips 91 and 92 substantially uniformly outwardly in all directions toward the surrounding rim part 52 so as to optimize the support provided by the inner shell. At the same time, when the occupant vacates the chair, the shell and specifically the center membrane part will readily resume its original nonloaded configuration.

Considering now the construction of the seat assembly 16, and referring specifically to FIGS. 10–16, this seat assembly 16 includes a seat member 101 which mounts on and generally above the control mechanism 15 and which includes, as a part thereof, a ringlike support frame 102. This support frame 102 in turn mounts on the upper surface thereof an inner seat shell 103 which extends across the ringlike support frame 102. This inner seat shell 103 is constructed generally similar to the back shell 51, and is described in greater detail hereinafter.

Considering first the construction of the seat support member 101, it includes a center mounting structure 111 which is similar to a shallow inverted box and specifically includes a generally horizontally extending platelike top wall 112 which is integrally jointed to downwardly projecting front and side flanges 113 and 114, respectively, which flanges and top wall cooperate to define a downwardly opening recess 115 therein. This latter recess at least partially accommodates the control housing 14 therein. A plurality of spacers 116 are secured to and project downwardly from the top wall 112 for bearing and supportive engagement on the top support or seat plate 21 of the tilt control mechanism 15. A plurality of fasteners such as screws (not shown) join the top wall 112 to the seat support plate 21.

The seat member 101 also has respective front and rear arms 118 and 119 which are integrally joined to each of the side flanges 114 of the center mounting structure and which project outwardly in generally parallel relation toward the respective adjacent side of the chair, with these arms 118 and 119 also sloping upwardly as they project outwardly. The arms 118 and 119 each, in the illustrated embodiment, have a generally shallow downwardly-opening channel-like cross section, and the outer ends of each adjacent pair of arms 118 and 119 are integrally joined to the respective side rail 121 of the ringlike seat support frame 102. The side rails 121 of the ringlike frame 102 extend in generally parallel relationship in the front-to-back direction of the chair, and the rearward ends of the side rails 121 are joined through rounded corners to a generally horizontally and transversely extending rear rail 122. The seat frame 102 also includes a generally horizontally elongated front rail 123 which extends in generally parallel relationship to the rear rail 122 and transversely joins through rounded corners to the front ends of the side rails 121. The support frame 102 thus defines an enlarged center opening 124 which projects vertically therethrough and which communicates with an open region 125 which is defined thereunder, which open region is defined vertically between the ring-shaped support frame 102 and the top wall 112. This open region 125 is accessible from the front and rear of the seat member 101, and is also accessible from the sides through openings 106 which are defined between each adjacent pair of arms 118–119.

The seat member 101 is preferably constructed as an integral one-piece member, such as by being molded of a structural or engineered resin material such as a glass-filled nylon having the requisite strength and rigidity.

Figure 13:
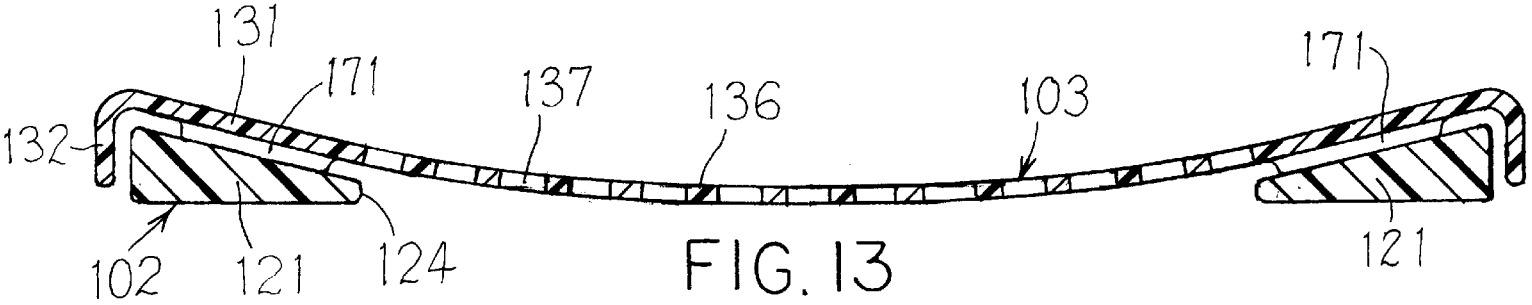
FIGS. 13 and 14 are sectional view respectively taken generally along lines 13—13 and 14—14 in FIG. 11 and showing the positioning of the seat membrane relative to the frame.
Figure 14:
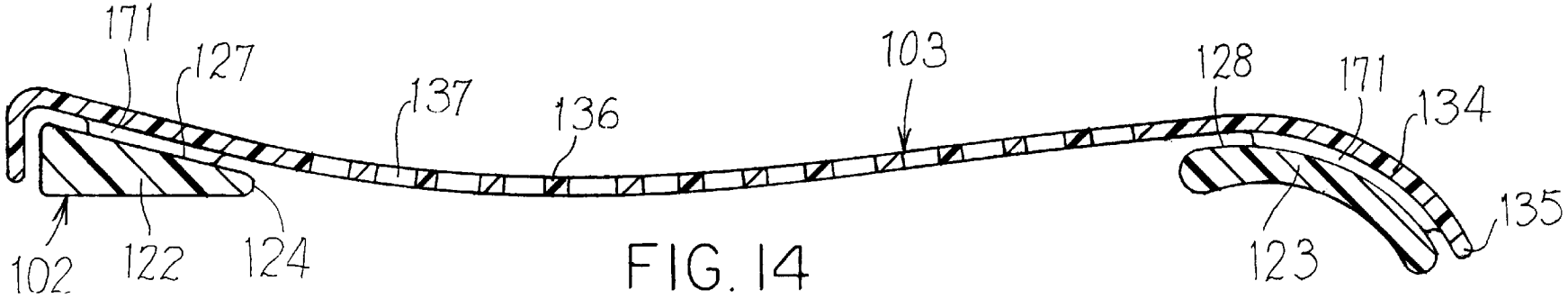

The rear rail 122 as well as the side rails 121 of the seat frame 101 preferably have a configuration which, when viewed in cross section as illustrated in FIGS. 13 and 14, is of a generally triangular or wedgelike shape which is of reduced thickness as the cross section projects toward the center opening 124. This results in the rails 121 and 122 having an upper surface 127 which, as it projects inwardly to the center opening, is slightly sloped downwardly to thus provide improved seating comfort for the overall seat assembly.

As to the front rail 123, it has a somewhat different cross sectional configuration which, as illustrated in FIG. 14, results in an upper surface 128 which has a generally rounded and smoothly curved convex configuration which rounds downwardly along the front outer edge of the front rail to provide improved seating comfort along the front edge of the chair. This front rail 123 preferably is of greater width along the center part 129 thereof, which increased width results in a greater downward curvature along the front edge so as to provide the chair with a front edge which is more smoothly curved, thereby providing the front edge of the chair with what is known as a "waterfall" configuration.

Considering now the construction of the inner seat shell 103 and referring specifically to FIGS. 11–14, this seat shell 103 is constructed similar to the back shell 51 and includes a surrounding annular or ringlike retainer or rim part 131 which defines thereon, at least along the rear and side edges thereof, a downwardly projecting edge flange 132 which projects downwardly so as to exteriorly overlap the side edges of the side and rear frame rails 121 and 122. The rim part 131, as illustrated by FIGS. 13 and 14, has a generally downwardly-opening channel-like configuration which receives therein the respective rail of the support frame 102. The transversely extending front portion of the rim part 131, however, is of a slightly shallower and more rounded channel-shaped cross section and has a smooth convex upper surface 134 so that the front part of the rim fits over and more closely conforms to the shape of the front rail 123. The rim part 131 defines thereon a front edge 135 which is disposed closely adjacent the front edge of the front rail, as illustrated in FIG. 14.

The inner seat shell 103 also includes a generally enlarged center membrane part 136 which extends generally transversely across the surrounding outer rim part 131, whereby this center membrane part 136 thus effectively extends across the large center opening 124 of the seat support frame 102. The center membrane part 136 has a series of openings 137 therethrough which are defined by a plurality of transversely extending and intersecting strips so that the center membrane part 136 thus is configured generally identical or at least similar to the configuration of the center membrane part 55 associated with the back shell 51. The center membrane part 136 of the seat shell 103, however, while it closely approaches a generally flat and planar configuration, is nevertheless preferably provided with a very shallow upwardly-oriented rounded and convex configuration, as illustrated by the cross sectional views of FIGS. 13 and 14. This shallow and smoothly curved convex configuration of the center membrane part 136 thus results in the outer portions thereof being smoothly curved to define a smooth transition where the center membrane part 136 joins to the surrounding rim part 131. This cross sectional configuration of the seat shell and specifically center membrane part is believed to provide improved seating comfort.

In addition, the seat shell 103 is preferably formed, as by being molded, as an integral one-piece, sheetlike structure of uniform thickness similar to the back shell 51 as described above, although the seat shell 103 may be formed from a higher-strength engineered resin material, such as nylon. Since the remaining overall construction of the seat shell 103 including the center membrane part 136 thereof otherwise generally corresponds to the structural and functional properties of the back shell 51 described above, further detail description of the seat shell is believed unnecessary.

The seat assembly 16 includes a cushion, specifically a foamed cushion 141, which extends generally coextensively over and is support on the upper surface of the inner seat shell 103. This cushion 141 can be premolded and preshaped if desired, and the cushion in turn has a suitable upholstery cover 142, such as a thin flexible fabric, positioned thereover in a conventional manner. The edge 143 of the upholstery fabric wraps around not only the edge of the cushion but also the outer edge of the seat shell 103 so as to be captivated between the seat shell 103 and the respective rail 121, 122, 123 of the seat support frame 102, with the edge of the fabric being secured as by staples or the like to the underside of the inner seat shell.

If necessary or desired, a thin flexible sheet 144, such as of fabric or vinyl or other suitable material, can be sandwiched directly between the foam cushion 141 and the inner shell 103, particularly over the center membrane part 136. The use of this intermediate sheet 144 may be beneficial to prevent the foam cushion 144 from extruding into or through the openings associated with the center membrane part 136, and can also be used to improve the visual appearance of the underside of the seat.

The inner seat shell 103 is positioned over and is fixedly secured directly to the ring-shaped support frame 102 by appropriate securing devices which, in the illustrated embodiment, includes a pair of securing devices 148 which are disposed adjacent the rear corners of the seat, and a further pair of securing devices 149 which are disposed adjacent the front corners of the seat.

Figure 15:
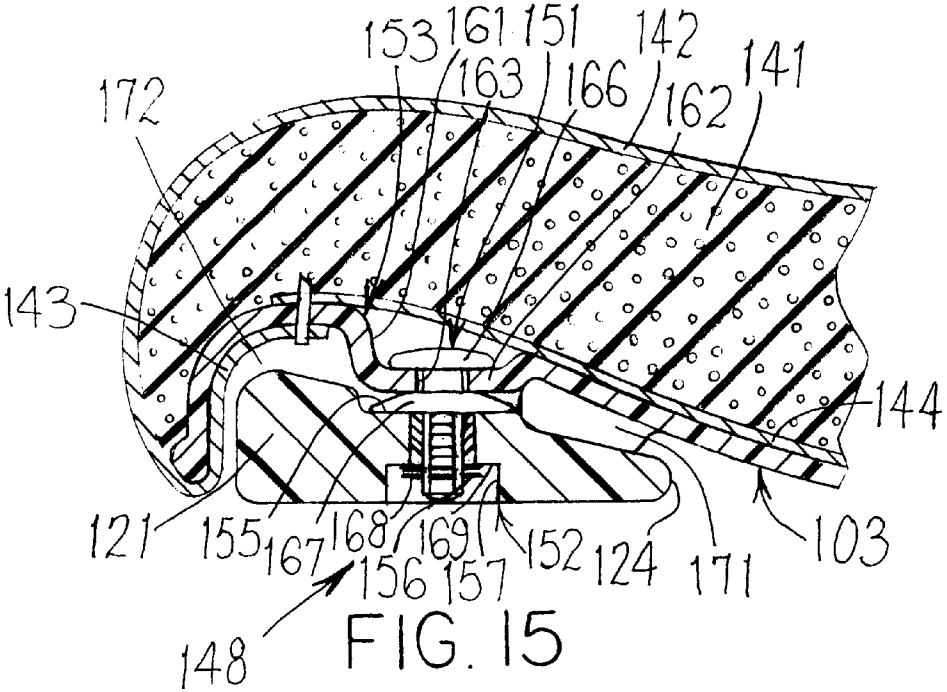
FIG. 15 is an enlarged sectional view taken generally along line 15—15 in FIG. 11 and illustrating the securement of the seat membrane to the seat frame adjacent the rear corners thereof.

As illustrated in FIG. 15, each rear securing device 148 includes a securing element 151 which is a conventional Christmas-type securing element which provides a fixed connection between a retaining portion 152 provided on the support frame 102 and a retaining portion 153 provided on the seat shell 103. The retaining portion 152 includes a shallow cuplike recess which is formed downwardly in the upper surface of the rail of the seat frame and which defines a generally flat bottom wall 155. An opening 156 projects downwardly through this bottom wall 155, which opening is of smaller diameter and which opens into an enlarged diameter bore 157 which then projects downwardly through the bottom surface of the seat frame.

The retaining portion 153 on the inner seat shell is similarly formed and is defined by a generally downwardly depressed cuplike recess 161 formed in the rim part adjacent the corner thereof, and this cuplike recess is defined by a generally flat bottom wall 162 having an opening 163 therethrough and adapted to be disposed vertically aligned above the openings 156–157 when the seat shell and seat frame are superimposed.

The securing element 151, as is conventional with known fasteners, is constructed of a plastics material and has an elongate stem provided with a screw-type cam or head 166 at one end thereof, and additionally has an outwardly projecting flange 167 spaced a limited distance downwardly from the head 166. The screw-type cam or head 166 can be threaded through the opening 163 in the seat shell to thus captivate the seat shell between the head 166 and flange 167 as illustrated in FIG. 15. The remaining downwardly projecting portion of the stem has a plurality of radially outwardly projecting resilient flanges 168 which are typically upwardly sloped. These flanges deflect radially inwardly as the stem is inserted downwardly through the small opening 156, with the lower flanges 168 then deflecting outwardly to project under the shoulder 169 to thus secure the overall assembly substantially as illustrated in FIG. 15.

The lower surface of the rim part 131 of seat shell 103 is, like the back shell 51, preferably provided with downwardly projecting ribs 171 which are associated with at least the inner portion of the rim part so as to provide supportive engagement with the upper surface of the seat frame 102. The outer portion of the lower surface of the rim part 131, however, is normally free of ribs and is spaced from the seat frame 102 by an open space or region 172 therebetween so as to readily accommodate the stapled inner edge 143 of the upholstery fabric 142. This construction of the inner seat shell, the ribs and the space for the edge fabric, is thus generally the same as that associated with the back assembly 16 as described above.

Figure 16:
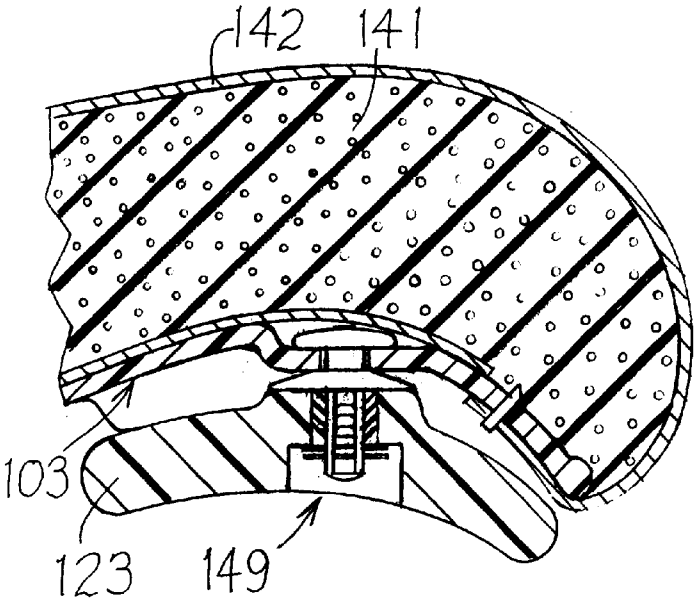
FIG. 16 is an enlarged sectional view taken generally along line 16—16 in FIG. 11 and illustrating the securement of the seat membrane to the seat frame adjacent the front corners thereof.

With respect to the front securing devices 149, they are structurally and functionally the same as the rear securing devices 148 except they are modified to the extent necessary so as to compensate for the slightly different curvature of the front rim part and front rail, as illustrated in FIG. 16. Further detailed description of the front securing devices is thus believed unnecessary.

The construction of the seat member 101 and the rather large open region 125 defined therein, which region is below the center membrane part 136 of the seat shell 103, thus not only enables the desired downwardly deflection of the center membrane part 136 of the seat shell, but also provides significant space of control members necessary for accessing the various chair control functions. For example, since the chair control mechanism 15 provides not only rearward tilt of the chair but also locking of the chair in a desired tilted position, such as is conventional, a pair of control elements terminating in knobs or paddles 181 and 182 (FIG. 1) can be provided adjacent one side of the seat assembly directly under one side edge thereof, and these control knobs can project inwardly through appropriate openings or slots in the arms 118 and 119 to thus connect to mechanisms associated with the tilt control mechanism 15. Similarly, the control handle 183 for the height adjusting cylinder can also be disposed adjacent one side of the chair, with the arm of the handle 183 projecting inwardly below the seat member 101 so as to access and hence permit activation of the control valve which is conventionally associated with the upper end of the height adjusting cylinder.

While the center membrane parts of both the seat and back shells have been described above as having openings extending through the thickness thereof, it will be appreciated that the center membrane parts can, if desired, be provided with thin webs or flashings of reduced thickness extending between the adjacent sinusoidal strips 91 and 92 whereby the overall membrane will still have the same general appearance and resilient properties, but the thin flashings will prevent visual see through of the center membrane part.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a base, a seat arrangement mounted on the base, and a back arrangement interconnected to the base and positioned adjacent a rear edge of said seat arrangement and projecting upwardly therefrom, the improvement wherein one of said seat and back arrangements comprises:

a rigid ringlike frame member disposed in surrounding relation to an enlarged central opening which extends through said frame member;

a one-piece inner shell fixedly mounted on and disposed in overlying relationship to one face of said frame member, said shell being constructed of a thin sheetlike resin material which is at least semi-rigid in the plane thereof;

said shell including a ringlike retainer part which substantially directly overlies and is fixedly secured to said ringlike frame member;

said shell also including an enlarged and substantially flat sheetlike center membrane part of substantially uniform thickness, said center membrane part extending between and integrally joined to said ringlike retainer part and extending across and substantially closing off the central opening of said ringlike frame member whereby said center membrane part is generally free of underlying support;

said center membrane part having a plurality of openings extending transversely therethrough so as to define a plurality of sidewardly spaced first elongate strips which extend transversely across and are integrally joined at opposite ends to said ringlike retainer part, and a plurality of sidewardly spaced second elongate strips which extend transversely across and are integrally joined at opposite ends to said ringlike retainer part, said first and second strips extending across said ringlike retainer part in intersecting transverse directions with said first and second strips being integrally joined where they intersect, whereby said center membrane part is transversely elastically deformable due to application of a transverse external load on said center membrane part;

a cushion positioned on and generally coextensively overlying an exposed face of said inner shell so that said inner shell is interposed between said cushion and said frame member; and a flexible sheetlike covering overlying the cushion.

2. A chair according to claim 1, wherein said frame member and said inner shell are associated with said back arrangement, and wherein said center membrane part is visible from a back side of said chair.

3. A chair according to claim 1, wherein each of said back and seat arrangements is defined by a said ringlike frame member having a said inner shell fixedly secured thereto in superimposed relationship therewith, and a said cushion is disposed to overlie the respective inner shell.

4. A chair according to claim 1, including a thin and flexible sheetlike element sandwiched between said cushion and said inner shell in overlying relation to the center membrane part so that said sheet overlies the openings which penetrate said membrane part.

5. A chair according to claim 1, wherein the first and second strips are each of a wavy or undulating configuration within the plane of the center membrane part as the strip extends between opposite ends thereof.

6. A chair according to claim 5, wherein each of the first and second strips are of a generally sinusoidal configuration.

7. A chair according to claim 5, wherein said inner shell has a thickness throughout said center membrane part and said ringlike retainer part in the range of between about 1/8 and about 3/16 inch.

8. A chair according to claim 1, wherein said ringlike frame member is defined by frame rails which have a width, as defined between inner and outer peripheral edges thereof, which is substantially greater than the thickness thereof, and said ringlike retainer part of said shell having a width which extends inwardly from an outer free edge of the shell to an inner edge where the retainer part joins to the center membrane part, the width of said retainer part being of similar magnitude as the width of the rails defining the frame member, the width of said retainer part being significantly greater than the thickness of said inner shell.

9. A chair according to claim 8, wherein said retainer part has a generally shallow channel-like cross section which opens toward the respective rail of the frame member to accommodate the latter therein.

10. A chair according to claim 9, wherein said inner shell has, along at least several outer edges of the ringlike retainer part, a transversely projecting cantilevered edge flange which is disposed outwardly of and at least partially overlaps an outer peripheral edge of the respective rail of the frame member.

11. A chair according to claim 1, wherein said frame member and inner shell are associated with said seat arrangement, said seat arrangement including a one-piece support member which includes a center mounting part which is positioned centrally of and in downwardly spaced relation from said ringlike frame member so as to define an open region therebetween, said seat member also including an arm structure fixed to each side of said center mounting part and projecting upwardly and outwardly relative thereto for fixed securement to an undersurface of said ringlike frame member adjacent one side thereof.

12. A chair according to claim 11, including a control mechanism positioned under and connected to said center mounting part for controlling rearward tilting of at least said back arrangement, said control mechanism being mounted on an upper end of a pedestal which is associated with and projects upwardly of said base.

13. A chair according to claim 12, wherein said ringlike support frame defines a visible back side of the chair, and wherein said center membrane part is visible from the back side of said chair through said central opening.

14. A chair according to claim 12, wherein said inner shell is injection molded in one piece of an engineered resin material and has a substantially uniform thickness in the range of from about ⅛ inch to about 3/16 inch.

15. A chair according to claim 12, including a vertically enlarged flexible cushion disposed in overlying and supportive engagement with a front surface of said inner shell, and a flexible upholstery cover overlying the cushion, said upholstery covering having an outer edge portion which wraps around an outer edge of said inner shell and projects between said inner shell and said support frame for securement to a rear surface of said inner shell.

16. A chair having a generally horizontally enlarged seat and a generally vertically enlarged back positioned adjacent a rear edge of said seat and projecting upwardly therefrom, comprising:

said back including a vertically enlarged and generally rectangular ringlike support frame defined by sidewardly-spaced and upwardly projecting side rails which are rigidly and integrally joined by transversely extending and vertically spaced top and bottom rails, said support frame defining an enlarged central opening which is bounded by said rails and extends horizontally through said frame;

said back also including a generally vertically enlarged one-piece inner shell which is disposed in front of and generally overlies said frame and extends coextensively across said central opening, said inner shell being constructed from a relatively thin sheetlike resin material having limited resiliency in a direction generally transverse to the shell, said shell having a vertically enlarged and sheetlike center membrane part which is of substantially uniform thickness and extends coextensively across said central opening of said frame, said shell also having a generally rectangular ringlike retainer portion which is integrally joined to and surrounds said center membrane part, said retainer portion being disposed so as to be substantially directly superimposed over said frame;

securing structure coacting between said frame and said rectangular retainer portion for fixedly securing said inner shell to said frame;

said center membrane part having a plurality of openings extending transversely therethrough so that the membrane part is defined by a plurality of first strips which extend generally vertically of the shell and a plurality of second strips which extend generally horizontally of the shell, said first and second strips being coplanar and integrally joined at points of intersection, whereby said center membrane part is transversely resiliently deflectable due to application of a rearwardly directed external load thereto; and said rim portion having a shallow channel-like cross section which opens rearwardly for accommodating the respective rail of the frame therein.

17. A chair according to claim 16, wherein each of said first and second strips are of a wavy or undulating configuration throughout the length thereof.

18. A chair according to claim 17, wherein each adjacent pair of first strips and each adjacent pair of second strips are positionally oriented so as to be substantially mirror images of one another.

19. A fastener for permitting releasable connection between first and second structures, comprising:

a first one-piece fastener member of a plastic material adapted for a spin weld fixed securement to said first structure;

a second one-piece fastener member of a plastic material adapted to be coupled to said second structure;

said first fastener member including first and second walls maintained in generally spaced relation and joined by an upright so that said first and second walls define an open region therebetween, said open region being accessible through a transverse opening which extends between said first and second walls and opens transversely thereof, said first wall being adapted for a spin weld fixed securement to said first structure, and said second wall having a slot which opens inwardly from a free edge thereof and terminates in a closed end; and said second fastener member including an elongate stem having a plurality of resilient projections formed thereon and projecting radially outwardly therefrom at spaced intervals therealong, and an enlarged head defined at one end of said stem, said head being insertable through said opening into said open region so as to be captivated between said first and second walls with said stem projecting outwardly through the slot defined in said second wall for permitting said stem and the resilient projections thereon to be engaged with said second structure.

20. A fastener according to claim 19, wherein said first structure comprises a substantially rigid ringlike frame element of a chair, wherein said second structure comprises an enlarged sheetlike flexible membrane which is positioned on and extends across said frame element, and wherein said first wall has a pair of fractureable flanges secured to and projecting radially outwardly from diametrically opposite sides of said first wall for permitting engagement with a spin weld driving tool.

21. A chair having a generally horizontally enlarged seat arrangement and a generally vertically enlarged back arrangement projecting upwardly from a rear edge of said seat arrangement, at least one of said seat and back arrangements comprising:

a rigid frame member defining an enlarged central opening which opens toward an occupant; and a one-piece inner shell fixedly supported on said frame member to support an occupant, said inner shell being constructed of a thin sheet-like resin material which is at least semi-rigid in the plane thereof;

said inner shell including a peripheral rim part which substantially directly overlies and is fixedly secured to said frame member;

said inner shell also including an enlarged and substantially flat sheet-like center membrane part, said center membrane part extending between and joined to said rim part and extending across the central opening of said frame member whereby said center membrane part is generally free of support in said central opening;

said center membrane part having a plurality of sidewardly spaced first elongate strips which are integrally joined at opposite ends to said rim part, and a plurality of sidewardly spaced second elongate strips which are integrally joined at opposite ends to said rim part, said first and second strips extending across said rim part in intersecting transverse directions so as to intersect one another with said first and second strips being integrally joined where they intersect, said center membrane part being transversely elastically deformable due to application of a transverse external load on said center membrane part by an occupant to support the occupant.

22. A chair according to claim 21, wherein said first strips and said second strips define openings which open transversely through said center membrane part.

23. A chair according to claim 21, wherein said first and second strips are each of a wavy or undulating configuration within the plane of the center membrane part as the strips extend between opposite ends thereof.

24. A chair according to claim 23, wherein each adjacent pair of said first strips and each adjacent pair of said second strips are positionally oriented so as to be substantially mirror images of one another.

25. A chair according to claim 21, wherein said frame member includes supporting frame sections connected to said rim part, said rim part including an outer flange which projects transversely from said rim part and is disposed outwardly of an outer edge of each of said frame sections.

26. A chair according to claim 25, wherein said frame sections are elongate rails on which said rim part is supported.

27. A chair according to claim 26, wherein said frame sections are joined together in a ring-like shape.

28. A chair according to claim 27, wherein said frame sections have an outer edge and an inner edge and a support surface extending therebetween, said support surface sloping transversely away from an occupant toward said inner edge.

29. A chair having a generally horizontally enlarged seat arrangement and a generally vertically enlarged back arrangement projecting upwardly from a rear edge of said seat arrangement, at least one of said seat and back arrangements comprising:

a rigid frame member defining an enlarged central opening which opens toward an occupant; and an inner shell fixedly supported on said frame member to support an occupant;

said inner shell including a peripheral rim part which substantially directly overlies and is fixedly secured to said frame member;

said inner shell also including an enlarged and substantially flat sheet-like center membrane part which is constructed of a thin resin material which is at least semi-rigid in the plane thereof, said center membrane part extending between and joined to said rim part and extending across the central opening of said frame member whereby said center membrane part is generally free of support in said central opening;

said center membrane part having a plurality of sidewardly spaced first elongate strips which are joined at opposite ends to said rim part, and a plurality of sidewardly spaced second elongate strips which are joined at opposite ends to said rim part, said first and second strips extending in transverse intersecting directions so as to intersect one another with said first and second strips being integrally joined where they intersect, said first and second strips each having a wavy or undulating configuration within the plane of the center membrane part as the strips extends between opposite ends thereof, said center membrane part being transversely elastically deformable due to application of a transverse external load on said center membrane part by an occupant to support the occupant.

30. A chair according to claim 29, wherein adjacent pairs of said first strips and adjacent pairs of said second strips define openings therebetween which open transversely through said center membrane part.

31. A chair according to claim 29, wherein said inner shell has a one-piece construction defined by said resin material such that said first strips, said second strips and said rim part are integrally joined together.

32. A chair according to claim 29, wherein said frame member includes frame sections on which said rim part is supported.

33. A chair according to claim 32, wherein said frame sections are joined together in a ring-like shape corresponding to said rim part.

* * * * *